United States Patent [19]

Evans et al.

[11] Patent Number: 4,975,062

[45] Date of Patent: Dec. 4, 1990

[54] HERMAPHRODITIC CONNECTOR

[75] Inventors: Billy D. Evans, Dallas; Joseph P. Howard, Euless; William C. Phelps; Shannon M. Reeves, both of Arlington, all of Tex.

[73] Assignee: Motorola, Inc., Schaumburg, Ill.

[21] Appl. No.: 464,579

[22] Filed: Jan. 11, 1990

Related U.S. Application Data

[63] Continuation of Ser. No. 356,661, May 19, 1989, abandoned, which is a continuation of Ser. No. 243,209, Sep. 9, 1988, abandoned, which is a continuation of Ser. No. 83,484, Aug. 10, 1987, abandoned.

[51] Int. Cl.[5] ..... H01R 13/28; H01R 25/00; H01R 39/00

[52] U.S. Cl. ..... 439/13; 439/31; 439/65; 439/288

[58] Field of Search ..... 439/113, 31, 65, 79, 439/75, 286, 288, 292

[56] References Cited

U.S. PATENT DOCUMENTS

| | | | |
|---|---|---|---|
| 1,278,850 | 9/1918 | Campbell . | |
| 1,678,166 | 7/1928 | Repay . | |
| 2,474,070 | 6/1949 | Sokolik . | |
| 3,180,869 | 6/1965 | Avery | 339/258 |
| 3,190,978 | 6/1965 | Huget | 200/51 |
| 3,316,522 | 4/1967 | Demler, Sr. | 339/47 |
| 3,386,069 | 5/1968 | Eriksson | 339/7 |
| 3,430,180 | 2/1969 | Brown | 339/8 |
| 3,601,746 | 8/1971 | Teagno | 339/4 R |
| 3,966,290 | 6/1976 | Little et al. | 439/74 |
| 4,273,401 | 6/1981 | Katzin | 339/47 |
| 4,475,779 | 10/1982 | Fohl | 339/5 |
| 4,496,202 | 1/1985 | Beckmann et al. | 339/5 |
| 4,632,475 | 12/1986 | Tomita | 439/1 |
| 4,657,320 | 4/1987 | Bamford et al. | 339/4 |
| 4,701,133 | 10/1987 | Worth | 439/13 |

*Primary Examiner*—Eugene F. Desmond
*Attorney, Agent, or Firm*—Steven G. Parmalee

[57] ABSTRACT

An hermaphroditic electrical connector comprising a pair of substantially identical body members. The two body members are arranged to be releasably secured together to electrically connect plural electrical contacts of one member to respective electrical contacts of the other member and for maintaining such electrical connections while enabling the two connector members to be pivoted with respect to each other about a longitudinal axis through a predetermined angular range.

6 Claims, 3 Drawing Sheets

HERMAPHRODITIC CONNECTOR

This is a continuation of application Ser. No. 07/356,661, filed May 19, 1989 and now abandoned, which is a continuation of application Ser. No. 07/243,209 filed Sept. 9, 1988 and now abandoned, which is a continuation of application Ser. No. 083,484, filed Aug. 10, 1987, now abandoned.

TECHNICAL FIELD

This invention relates generally to electrical connectors and more particularly to multiple contact connectors having two portions that are readily releasably securable to one another and which can be pivoted with respect to each other while maintaining good electrical contact therebetween.

BACKGROUND ART

In most types of electrical or electronic equipment today, multiple-contact electrical connectors are used to effect the interconnection of some portions of the electrical circuitry of the equipment to each other or to associated or auxiliary equipment. Such connectors commonly comprise a pair of connector members or bodies, each including plural electrical contacts, that are electrically connected to respective portions of the equipment either directly or through the use of cables. The two connector bodies are usually adapted to be releasably secured together so that the contacts of one body member electrically engage respective contacts of the other member.

In many instances, it is desirable to move the contact members with respect to each other while maintaining the electrical continuity of their contacts. Such action may be desirable in order to gain easy access to portions of the associated equipment or to adjust the connector to a desired orientation to accommodate the physical constraints of the equipment's housing, support or environment.

That need has not heretofore been satisfactorily fulfilled by prior art connectors which are simple in construction, can be connected and disconnected from each other readily, are effective in operation and suitable for long term, reliable operation.

SUMMARY OF THE INVENTION

These and other needs are substantially met by providing an electrical connector comprising a pair of body members In a preferred embodiment, the body members are hermaphroditic and include plural electrical contacts. The body members are adapted to be readily secured to each other so that respective ones of the contacts of one member engage respective ones of the contacts of the other member in good electrical conductivity. The body members include means to enable them to be pivoted with respect to one another about a longitudinal axis through a predetermined angular range, while still maintaining good electrical conductibility between their contacts.

Each body member basically comprises a base portion including plural ribs projecting outwardly therefrom. When the connector members are secured together, their rib portions are interleaved and define therebetween plural internal spaces, with one electrical contact of one member and the corresponding electrical contact of the other member being located in each of the spaces. Each of the contacts comprises a cantilever portion having an engagement portion in the form of a surface disposed contiguous with the longitudinal axis. The cantilever portions are arranged to deflect when the two connector members are brought together, thereby facilitating the securement contacts and with their engagement surfaces in good electrical contact with each other irrespective of the angular orientation of one body member to the other about the longitudinal axis.

In accordance with a preferred aspect of the invention, each contact, in addition to the cantilever portion, includes an anchoring portion fixedly secured to the associated body member and a post extending out of the body member. The post serves as a terminal for connection to associated components. The cantilever portion is preferably formed of a strip of material defining a free end or nose portion, the heretofore identified engagement portion, and an arm portion. The engagement surface is preferably planar. The nose and arm portions of each contact are constructed to enable them to flex readily to facilitate the securement of the body members together, while ensuring that the plane of the engagement surface of each contact of one member remains parallel to the engagement surface of the corresponding contact of the other member.

In accordance with another preferred aspect of this invention, the means for connecting the two body members together basically comprises a hole formed through one end of each body member and a post disposed on a rib member at the other end of each body member. The post and hole are aligned on the longitudinal axis of the connector. The post be can readily snap-fit within the recess of the other body member, and vice versa.

In accordance with yet another preferred aspect of this invention, each of the ribs are constructed so as to substantially enclose the contact of the two body members within respective internal spaces therein. Thus, each of the ribs is an elongated member extending transversely to the longitudinal axis of the connector and having a pair of ends. Each end of each rib includes an enlarged width flange portion. The spacing between the enlarged width flange portions of immediately adjacent ribs is just slightly larger than the width of the flange portions themselves, whereupon when the two body members are connected together and their ribs interleaved, the flange portions of the ribs of one member are disposed within and substantially fill the spaces between the flange portions of the ribs of the other member, thereby enclosing the contacts within the respective spaces within the connector's body members.

BRIEF DESCRIPTION OF THE DRAWINGS

Other objects and many of the attendant advantages of the invention will be readily appreciated as the same becomes better understood by reference to the following detailed description when considered in connection with the accompanying drawing wherein.

DETAILED DESCRIPTION OF THE PREFERRED EMBODIMENT

Figure 1:
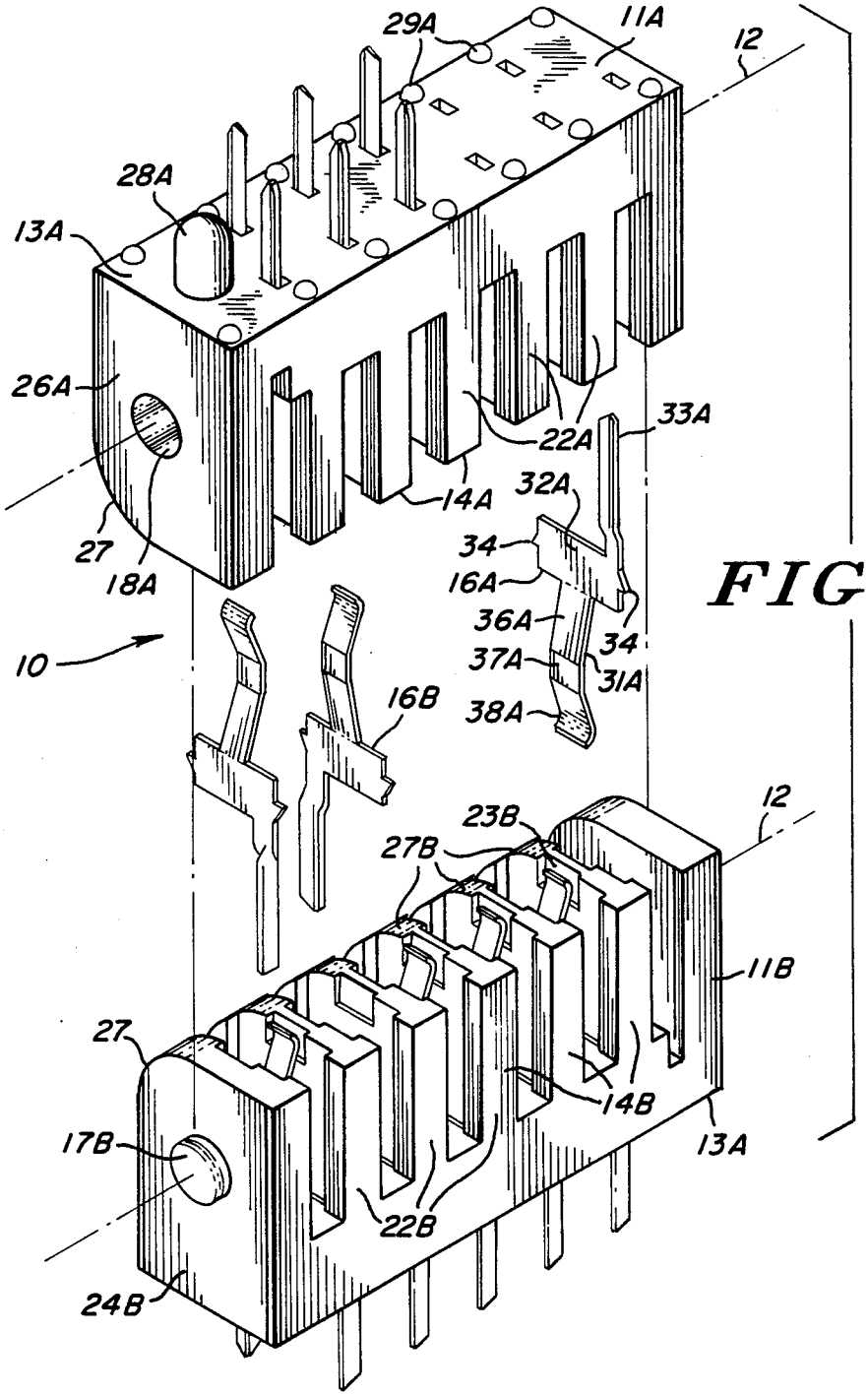
FIG. 1 is an exploded, perspective view of a pivotable, hermaphroditic connector constructed in accordance with the subject invention.
Figure 2:
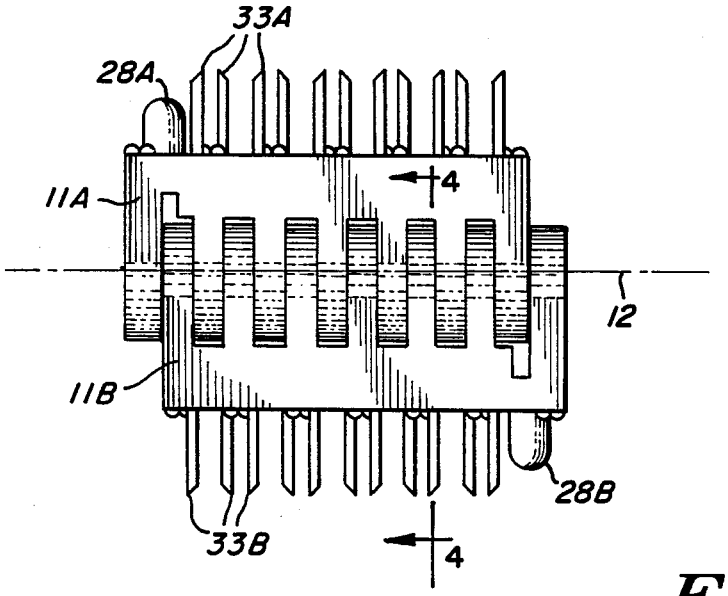
FIG. 2 is a front (or rear) elevational view of the connector shown in FIG. 1, but shown assembled.

Referring now to the various figures of the drawing wherein like reference characters refer to like parts, there is shown in FIG. 1 an hermaphroditic, pivotable connector constructed in accordance with the instant invention as depicted generally by the numeral 10. The connector (10) basically comprises a pair of identical body members or sections (11A and 11B). The two body members are arranged to be releasably secured to each other to effect the ready electrical interconnection of plural electrical contacts, to be described later, located within them, while enabling the two members to be pivoted with respect to each other through a predetermined angular range about a longitudinal axis (12) extending through the connector. In the embodiment shown herein the two connector sections (11A and 11B) are configured to be pivoted through an angular range of up to 90° about the axis (12). However, it should be pointed out that by appropriate construction of the members (11A and 11B) they may be enabled to pivot through angles in excess of 90°.

Inasmuch as the two connector members (11A and 11B) are of identical construction in a preferred embodiment of this invention their corresponding components or elements will be referred to by the same reference numerals, except for the suffix designation "A" or "B" to indicate the connector of which the reference component is a part. Moreover, in the interest of expediting the explanation of the structure and operation of the connector (10) reference may be made to a component part of both "11A and 11B". In such a case, the component will be described with the suffix "A/B" while the particular component shown in the drawing will bear a reference number having either an "A" or "B" suffix.

It should be pointed out at this juncture that the two body members need not be identical in construction in all aspects as shown herein so long as their major functional components (to be described below) are similar.

As can be seen in FIG. 1, each body member basically comprises a base portion (13 A/B), plural upstanding ribs (14 A/B), plural electrical contacts (16 A/B), and releasably securable connecting means in the form of a post (17 A/B) and a hole (18 A/B).

The details and operation of the two body members (11A and 11B) will be described in considerable detail later. Suffice for now to state that the two members are arranged to be releasably secured so that the ribs (14) of one member are interleaved with the ribs (14) of the other member to form respective internal spaces or chambers (19) (FIG. 5) therebetween. Disposed within each space (19) is a cantilever portion of the contract of one member and a cantilever portion of the corresponding contact of the other member. Those cantilever portions of the contacts each include a respective engagement surface which engage each other in good electrical contact contiguous with the axis (12) irrespective of the angular orientation of the two body members (11 A/B) with respect to the axis (24).

As can be seen, the base portion (13 A/B) of the body members (11 A/B) comprises an elongated, generally rectangular structure whose major dimension extends parallel to the longitudinal axis (12). The ribs (14 A/B) are in the form of outwardly projecting planar wall-like members extending transversely across the base portion (13 A/B); that is, transverse to the axis (12). Each rib (14 A/B) includes a pair of ends (21 A/B and 22 A/B) that are substantially wider than the thickness of the ribs themselves, but slightly less than the spacing between the flanges of immediately adjacent ribs. Accordingly, when the two body members (11A and 11B) are secured together and their ribs (14 A/B) are interleaved, one set of flanges (21A) substantially fill the spaces between the flanges (21B) on one side of the two interconnected body members while the remaining set of flanges (22A) substantially fill the spaces between the flanges (22B) on the other side of the body members. Accordingly, very little space (e.g., .001") is provided between the interleaved flanges at the end of the ribs through which dirt or debris from the ambient atmosphere may pass to gain ingress into the internal spaces (19) (FIG. 5) having the contacts located therein.

Figure 4:
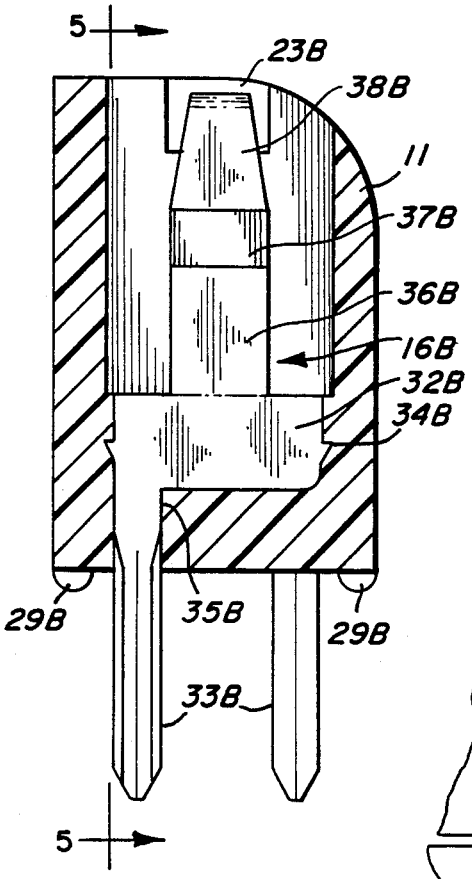
FIG. 4 is an enlarged sectional view taken along line 4—4 of FIG. 2.
Figure 5:
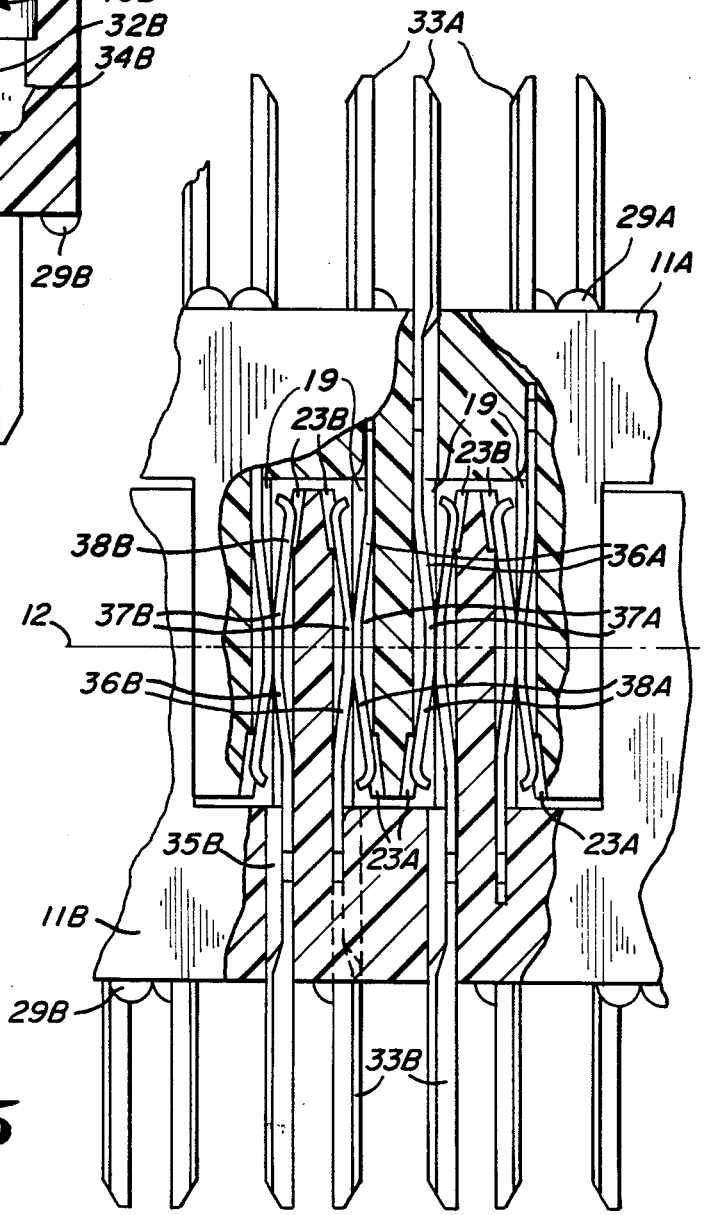
FIG. 5 is an enlarged sectional view taken along line 5—5 of FIG. 5.

As can be seen clearly in FIGS. 1, 4 and 5, a tapered recess (23 A/B) is provided in each surface of the ribs (14 A/B) contiguous with the outward edge thereof. These recesses serve to receive the free end or nose portion of the contacts (16 A/B) (to be described below) during the securement of the two members (11 A/B) together.

Figure 3:
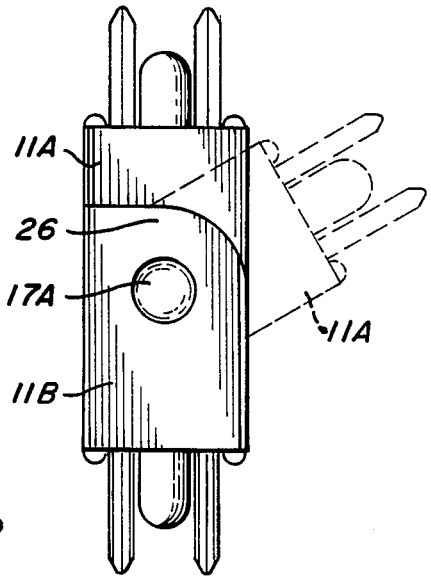
FIG. 3 is an enlarged end view of the connector shown in FIG. 2 and with the phantom lines depicting one exemplary angular orientation of the connector.

As noted earlier, the means for releasably securing the two body members together comprise a post (17) and an axially aligned hole (18) on each body member. The post (17) of one body member is arranged to be received within the hole (18) of the other body member, and vice versa, to secure the two members together in a pivotable arrangement. Thus, as can be seen clearly in FIGS. 1 and 3, the post (17 A/B) is mounted on a rib-like wall (24 A/B) at one end of the base (24 A/B). The wall (24 A/B) is somewhat similar in construction to the ribs (14) except that it is thicker. The post (17 A/B) projects outward from the outside face of the wall (24 A/B) and is axially centered on the axis (12). The hole (18 A/B) is similarly formed through the opposite end wall (26 A/B).

In order to ensure that the ribs do not interfere with the pivoting action of the two connectors (11A and 11B) with respect to each other, part of the top surface of the ribs is rounded (27).

As can be seen clearly in FIGS. 1, 2, 3, 4 and 5 a cylindrical pin (28), having a domed free end, projects perpendicularly to the planar bottom surface of the base of each member (11 A/B). This projecting pin (28) serves to key or locate the connector at a desired position on a printed circuit board (not shown) or other component (not shown) by fitting within a hole in the printed circuit board or other component at the desired position.

In order to hold the connector slightly off the surface of a printed circuit board plural domed standoffs (29 A/B) are provided on the bottom surface of each body member. These standoffs thus enable the printed circuit board to be washed or flushed under the connector.

In accordance with a preferred embodiment of this invention, the body members (11 A/B) are each molded as an integral unit of a tough, high temperature resistant, electrically insulative plastic, e.g., polyethylene terephthalate. One particularly effective polyethylene terephthalate is sold under the designation DP-3-1022 by Mobay Chemicals, although other suitable electrical insulating materials can also be used.

It should also be pointed out at this juncture that while the edges and corners of the body members (11

A/B) are shown in the drawing herein as being relatively sharp, they are, in fact, rounded.

Referring now to FIGS. 1, 4 and 5 the details of the plural contacts (16 A/B) will be discussed.

Each contact basically comprises three sections, namely, a cantilever section (31 A/B), a central or anchoring section (32 A/B), and a post or terminal section (33 A/B). Preferably, the contacts (16 A/B) are each formed as an integral unit of an electrically conductive and suitably hard and durable material, e.g., berylium copper or phosphor bronze, and which is plated with a very thin coating of suitable material(s) such as gold over nickel. One particularly effective way of forming the contacts is by stamping them from a relatively thin, e.g., 0.006 inch, strip of such material so as to cut and bend the contact into the desired shape in an easy operation.

As can be seen the anchoring section (32 A/B) constitutes the mid portion of the contact and is a relatively wide section having a pair of barbs (34) at its opposite ends. These barbs are provided to anchor the contact within a correspondingly shaped opening (see FIG. 5) in the member's base (24 A/B). The post portion (33 A/B) of each contact is an elongated finger extending from one side of the anchor portion (32 A/B) and is bent into a generally V-shaped cross-section along its length. This V-shape provides the post with substantial rigidity to serve as a terminal for connecting the contact (16 A/B) to any desired electrical component. Thus, the post (33 A/B) extends through a hole (35 A/B) (FIG. 4 and 5) in the base (24 A/B) of the member (11 A/B) and projects substantially beyond the bottom wall thereof for connection to terminals on a printed circuit board (not shown) or some other device (not shown) to which the connector (10) is to be electrically connected.

The cantilever section (31 A/B) of each contact (16 A/B) is an elongated fingerlike projection extending in the opposite direction as the post (33 A/B) from the anchoring portion (32 A/B). The cantilever portion (31 A/B) basically comprises three sequentially located portions, namely, an arm portion (36 A/B), an engagement surface portion (37 A/B), and a free end or nose portion (38 A/B). The engagement surface (37 A/B) in the preferred embodiment is generally planar and extends perpendicularly to the axis (12). The arm portion (36 A/B) is also planar and extends at a slight acute angle to the plane of the engagement surface (37 A/B) and to the plane of the anchoring portion (32 A/B). The nose or free end portion (38 A/B) is also planar and extends at a slight acute angle to the plane of the engagement portion (37 A/B) and the anchoring portion (32 A/B).

The free end of the nose portion (38 A/B) may be curved to expedite the ready insertion of the contacts together, as will be described later.

As will be appreciated by those skilled in the art, with the contacts mounted as described, the engaging surface portions (37 A/B) of each contact will be disposed in a plane transverse to the longitudinal axis and contiguous therewith. When the two body members are connected together, the nose portions (38 A/B) of the contacts (16) engage each other first, causing them and their associated arm portions (36 A/B) to flex. This action enables the engaging contacts to slide over each other until their engagement surfaces (37 A/B) are disposed in contact with each other. The recess (23 A/B) at the top of each rib provides a space into which the free end or nose of the associated contact may move to reduce the insertion force required to effect the securement of the contacts together.

In order to equalize the deflection of the arm and free end portions of the cantilever section of each contact and to provide for a low insertion force necessary to effect the ready connection of the two members (11 A/B) together, the free end of each of the contacts tapers from the contact surface (37 A/B) to the free end. Moreover, the length of the arm portion (36) is longer than that of the free end portion (38 A/B) to compensate for the increased flexibility provided by the reduced width nose portion. Thus, both the free end (nose) and arm portions of the contact deflect equally, to maintain the engaging surface (37 A) of each of the contacts (16A) parallel to the engaging surface (37) of the each of the contacts (16B).

As will be appreciated by those skilled in the art, by virtue of the fact that the electrical engagement of the contacts occurs at their planar portions (27A and 37B), which are relatively large in area and maintained parallel to each other, the current density through the contact area is kept sufficiently low. This feature greatly lessens the chance of galling (degrading) or other surface damage to the contacts. In this connection, as is known, concentration of current through a small area of an electrical contact can result in galling of the contact material and/or its plating. This problem is particularly acute if the contact surfaces are moved with respect to each other, such as in the case of a pivotable connector. By providing the enlarged contact areas through which the current passes, damage to the contact material, is minimized, if not obviated.

It should be pointed out at this juncture that the engaging surfaces need not be planar, if current density is not deemed a problem Thus, the engaging surface (37 A/B) may be domed, or any other suitable shape. What is important is the use of the flexible free end (nose) and arm portions of the contact. Such elements enable one to use a relatively rigid engagement surface of any suitable shape while ensuring that the connector (10) exhibits low insertion and withdrawal forces for connecting and disconnecting its two members together.

As will be appreciated by those skilled in the art, the low insertion and withdrawal forces which characterize the connector of this invention enable it to be constructed to include a large number of engaging contacts, e.g., 50 or more, and yet be readily connected and disconnected with minimum effort and without damage thereto.

Without further elaboration the foregoing will so fully illustrate my invention that others may, by applying current or future knowledge, adopt the same for use under various conditions of service.

We claim:

1. An electrical connector comprising a pair of body members, each of said body members including:

plural spaced-apart ribs;

means for releasably securing said body members together with their ribs interleaved to define respective spaces between immediately adjacent interleaved ribs, said releasably securable means enabling said members to pivot through a predetermined angular range about a longitudinal axis extending through said interleaved ribs; and plural electrical contacts, wherein each of said contacts includes:

a post section extending out of said body member;

an intermediate section connected to said post section; and an elongated cantilever section projecting from said body member in a direction towards said longitudinal axis so that when said members are secured together, the cantilever section of at least some contacts of one member are each disposed within a respective one of said spaces along with the cantilever section of a corresponding contact of the other member.

2. The electrical connector of claim 1 wherein said means for releasably securing said body members together includes a rib having a hole formed at least partially therethrough and a rib having a post formed thereon, such that when said members are secured together, said post becomes disposed at least partially within said hole.

3. The electrical connector of claim 2 wherein each of said body members includes a rib having a hole formed therethrough and a rib having a post formed thereon, such that when said members are secured together, said post on each of said body members will become at least partially disposed within said holes.

4. The electrical connector of claim 1 wherein said body members each includes a post for allowing said body members to be properly placed on a circuit board.

5. The electrical connector of claim 1 wherein each of said body members are substantially identical to one another.

6. An electrical connector comprising a body member that can be releasably secured to another of said body members, wherein said body member includes:

plural spaced-apart ribs;

means for releasably securing said body members together with their ribs interleaved to define respective spaces between immediately adjacent interleaved ribs, said releasably securable means enabling said members to pivot through a predetermined angular range about a longitudinal axis extending through said interleaved ribs; and plural electrical contacts, wherein each of said contacts includes:

a post section extending out of said body member;

an intermediate section connected to said post section; and an elongated cantilever section projecting from said body member in a direction towards said longitudinal axis so that when said members are secured together, the cantilever section of at least some contacts of one member are each disposed within a respective one of said spaces along with the cantilever section of a corresponding contact of the other member.

* * * * *